US007866453B2

(12) United States Patent
Wu

(10) Patent No.: US 7,866,453 B2
(45) Date of Patent: Jan. 11, 2011

(54) SWIVELABLE TRUNK WHEEL ASSEMBLY

(75) Inventor: Chen-Chuan Wu, Hsin Chuang (TW)

(73) Assignee: Hersun Plastic Co., Ltd., Taipei Hsien (TW)

( * ) Notice: Subject to any disclaimer, the term of this patent is extended or adjusted under 35 U.S.C. 154(b) by 503 days.

(21) Appl. No.: 12/116,986

(22) Filed: May 8, 2008

(65) Prior Publication Data

US 2009/0277737 A1 Nov. 12, 2009

(51) Int. Cl.
*B60B 33/00* (2006.01)

(52) U.S. Cl. ..... 190/18 A; 16/45; 16/47; 16/35 R; 188/1.12

(58) Field of Classification Search ..... 190/18 A, 190/115; 16/18 R, 45, 471, 48, 46, 35 R, 16/29, 47, 35 D; 188/1.12; 280/47.315, 280/DIG. 6; 206/315.3
See application file for complete search history.

(56) References Cited

U.S. PATENT DOCUMENTS 1,485,571 A * 3/1924 Stevens ..... 30/342
1,511,688 A * 10/1924 Stimpson ..... 411/363
4,677,706 A * 7/1987 Screen ..... 16/35 R
5,139,116 A * 8/1992 Screen ..... 188/1.12
6,532,624 B1 * 3/2003 Yang ..... 16/35 R
7,703,588 B2 * 4/2010 Chiang ..... 190/18 A
2007/0215414 A1 * 9/2007 Chiang ..... 188/1.12
2007/0289098 A1 * 12/2007 Tsai ..... 16/35 R

* cited by examiner

*Primary Examiner*—Tri M Mai
(74) *Attorney, Agent, or Firm*—Ming Chow; Sinorica, LLC

(57) ABSTRACT

The present invention discloses a swivelable trunk wheel assembly, which comprises: a wheel frame, a guide hole, a hollow pivotal shaft, a push rod, a press block, a sleeve pipe, two wheels and two rivets. The sleeve pipe adopts a metallic pipe having a better rigidity, and the inner surface of the sleeve pipe is a smooth surface. Further, the rivets and the sleeve pipe are arranged in the same axis. Thus, the wheels can rotate smoothly without stagnancy. Therefore, the swivelable trunk wheel assembly of the present invention has a better wear resistance and a longer service life. Besides, the present invention uses the push rod to drive the press block to rub the friction portion, and the friction can provide a braking effect on the wheels.

10 Claims, 4 Drawing Sheets

SWIVELABLE TRUNK WHEEL ASSEMBLY

BACKGROUND OF THE INVENTION

1. Field of the Invention

The present invention relates to a swivelable trunk wheel assembly, particularly to a brakable and swivelable trunk wheel assembly.

2. Description of the Related Art

Currently, most trunks have wheels on the bottom, whereby passengers can pull their trunks easily. The wheeled trunks may be divided into the two-wheel type and the four-wheel type. In a two-wheel type trunk, two support legs are arranged at two corners thereof, and two wheels are arranged at the other two corners, and the wheels are linearly-moving wheels or non-360 degree swivel wheels. A four-wheel type trunk has four 360 degree swivel wheels at four corners thereof. Wheeled trunks are indeed very popular. However, they are all unbrakable. Thus, four-wheel type trunks are hard to stand still. Although a two-wheel type trunk can stand by two support legs, the two unbrakable wheels make it hard to stand stably. Therefore, passengers cannot park their trunks arbitrarily, which should inconvenience passengers considerably.

Accordingly, the present invention proposes a swivelable trunk wheel assembly to solve the abovementioned problem.

SUMMARY OF THE INVENTION

The primary objective of the present invention is to provide a swivelable trunk wheel assembly having a braking function to solve the abovementioned conventional problem.

Another objective of the present invention is to provide a swivelable trunk wheel assembly, which has a better wear resistance and a longer service life.

The present invention proposes a swivelable trunk wheel assembly, which comprises: a wheel frame, a guide hole, a hollow pivotal shaft, a push rod, a press block, a sleeve pipe, two wheels and two rivets. The wheel frame has two accommodation portions arranged at two sides thereof. Two ends of the hollow pivotal shaft horizontally extend out from the two accommodation portions. The sleeve pipe is arranged inside the hollow pivotal shaft, and two ends of the sleeve pipe protrude out from two ends of the hollow pivotal shaft. The inner surface of the sleeve pipe is a smooth surface. The wheel frame, the hollow pivotal shaft and the sleeve pipe are fabricated into a one-piece part. One end of the push rod passes through the guide hole to connect with one end of the press block. The other end of the press block is pivotally coupled to the wheel frame. Two wheels are respectively coupled to two ends of the sleeve pipe and then accommodated in the accommodation portions. The wheel has a friction portion arranged in the side near the wheel frame. The push rod can push the press block to rub the friction portion and brake the wheels. The rivets respectively pass through the wheels and are joined to two ends of the sleeve pipe in the inner surface of the sleeve pipe. The sleeve pipe adopts a metallic pipe having a better rigidity, and the inner surface of the sleeve pipe is a smooth surface. Further, the rivets and the sleeve pipe are arranged in the same axis. Thus, the wheels can rotate smoothly without stagnancy. Therefore, the swivelable trunk wheel assembly of the present invention has a better wear resistance and a longer service life. Besides, the present invention uses the push rod to drive the press block to rub the friction portion, and the friction can provide a braking effect on the wheels.

Below, the embodiments will be described in detail in cooperation with the attached drawings to make easily understood the objectives, technical contents, characteristics and accomplishments of the present invention.

DETAILED DESCRIPTION OF THE INVENTION

Figure 1:
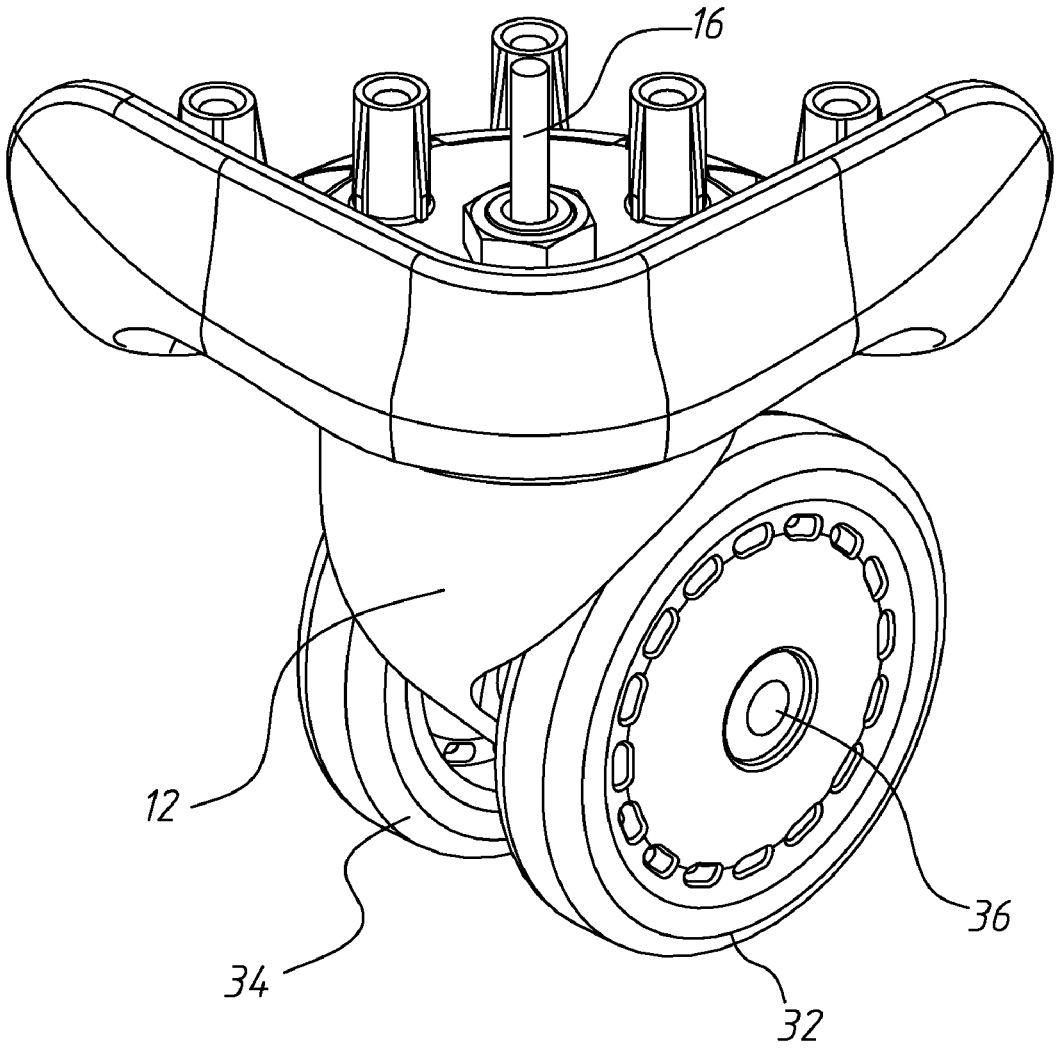
FIG. 1 is a perspective view schematically showing the structure of a swivelable trunk wheel assembly according to the present invention.
Figure 2:
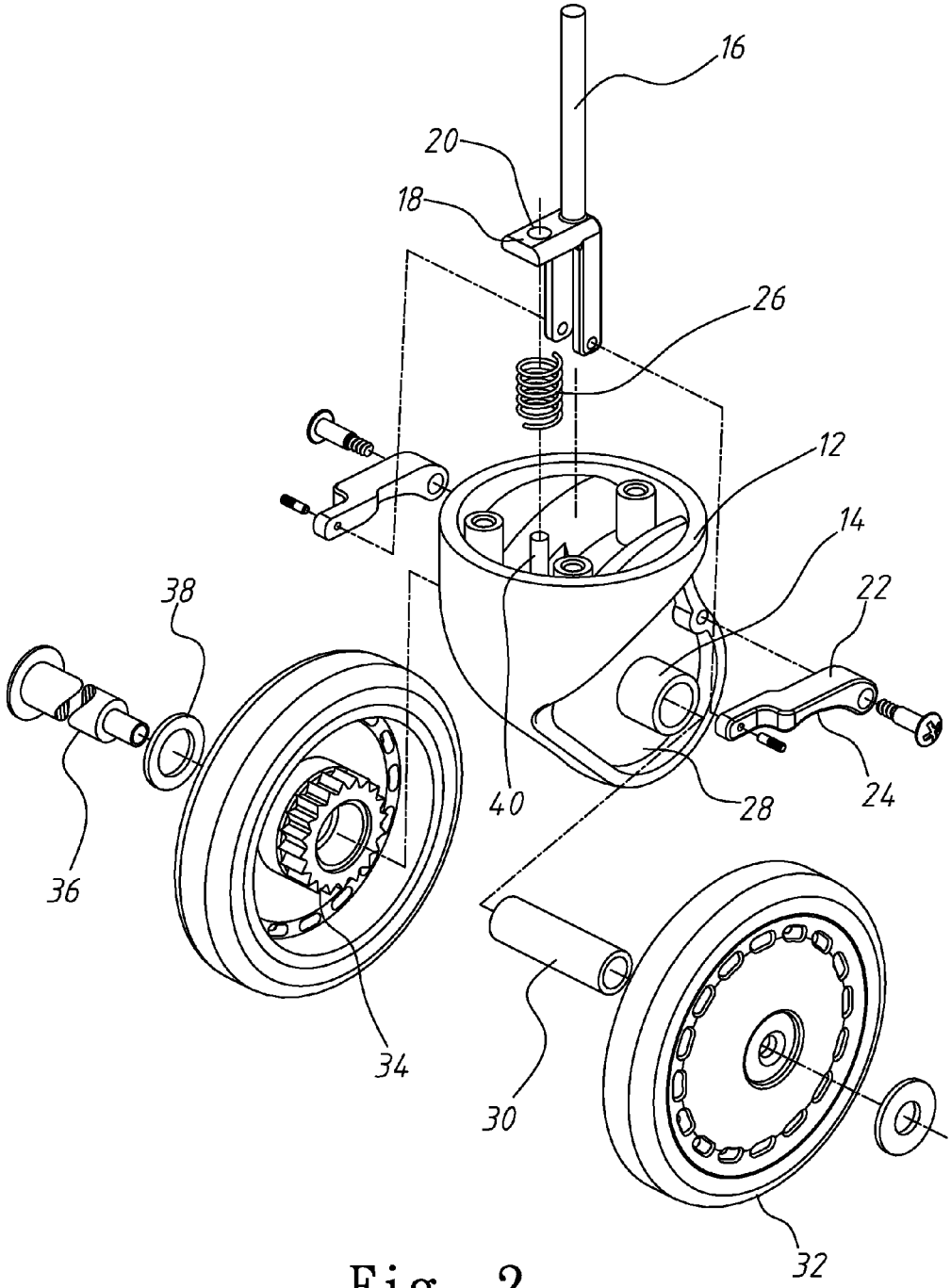
FIG. 2 is an exploded view schematically showing the structure of a swivelable trunk wheel assembly according to the present invention.

Refer to FIG. 1 and FIG. 2 respectively a perspective view and an exploded view schematically showing the structure of a swivelable trunk wheel assembly according to the present invention. The swivelable trunk wheel assembly of the present invention comprises: a wheel frame 12, a guide hole 42, a hollow pivotal shaft 14, a push rod 16, a press block 22, a sleeve pipe 30, two wheels 32 and two rivets 36. The wheel frame 12 has two accommodation portions 28 arranged at two sides thereof. The hollow pivotal shaft 14 is arranged in the wheel frame 12, and two ends of the hollow pivotal shaft 14 horizontally extend out from two accommodation portions 28. The sleeve pipe 30 is arranged inside the hollow pivotal shaft 14, and two ends of the sleeve pipe 30 protrude out from two ends of the hollow pivotal shaft 14. The sleeve pipe 30 may be a metallic sleeve pipe. Further, the wheel frame 12, the hollow pivotal shaft 14 and the sleeve pipe 30 may be fabricated into a one-piece part, wherein the sleeve pipe 30 may be placed inside an injection mold beforehand and then integrated with the wheel frame 12 and the hollow pivotal shaft 14 to form a one-piece part in a plastic injection molding process, whereby the wheel frame 12, the hollow pivotal shaft 14 and the sleeve 30 can be firmly joined together.

One end of the push rod 16 passes through the guide hole 42 to connect with one end of the press block 22. The other end of the press block 22 is pivotally coupled to the wheel frame 12. A lateral plate 18 horizontally extends out from between the two ends of the push rod 16. The lateral plate 18 has a through-hole 20. A vertical rod 40 on the wheel frame 12 is inserted into and sleeved by the through-hole 20. A compression spring 26 is arranged in the vertical rod 40 and provides elastic force to restore the push rod 16 and the press block 22 to the original positions. One end of the push rod 16 protrudes from the wheel frame 12 and is coupled to a control mechanism. The control mechanism may have a button arranged on the handle of the trunk. When a user presses the button, the control mechanism will drive the push rod 16 and the press block 22 to move.

Two wheels 32 are respectively coupled to two ends of the sleeve pipe 30 and then accommodated in the accommodation portions 28. The wheel 32 has a friction portion 34 arranged in the side near the wheel frame 12. The friction portion 34 is a coarsened body, and the coarsened body may be a gear or a streaked body. When the control mechanism drives the push rod 16, the push rod 16 will push the press block 22 to rub the friction portion 34 and brake the wheels 32. The press block 22 has a rubber face 24 in the side near the friction portion 34. The rubber face 24 may be joined with the press block 22 via inlay or wrapping. The rubber face 24 has flexibility and toughness, which can enhance the rubbing effect and wear resistance. Thus, the rubber face 24 can promote the braking effect. A washer 38 is arranged between the rivet 36 and the wheel 32. The rivets 36 pass through the wheels 32 and are joined to two ends of the sleeve pipe 30 in the inner surface of the sleeve pipe 30.

The sleeve pipe 30 may adopt a metallic pipe having a better rigidity, and the inner surface of the sleeve pipe 30 is a smooth surface. Further, the rivet 36 and the sleeve pipe 30 are arranged in the same axis. Thus, the wheels 32 can rotate smoothly without stagnancy. Therefore, the swivelable trunk wheel assembly of the present invention has a better wear resistance and a longer service life.

Figure 3:
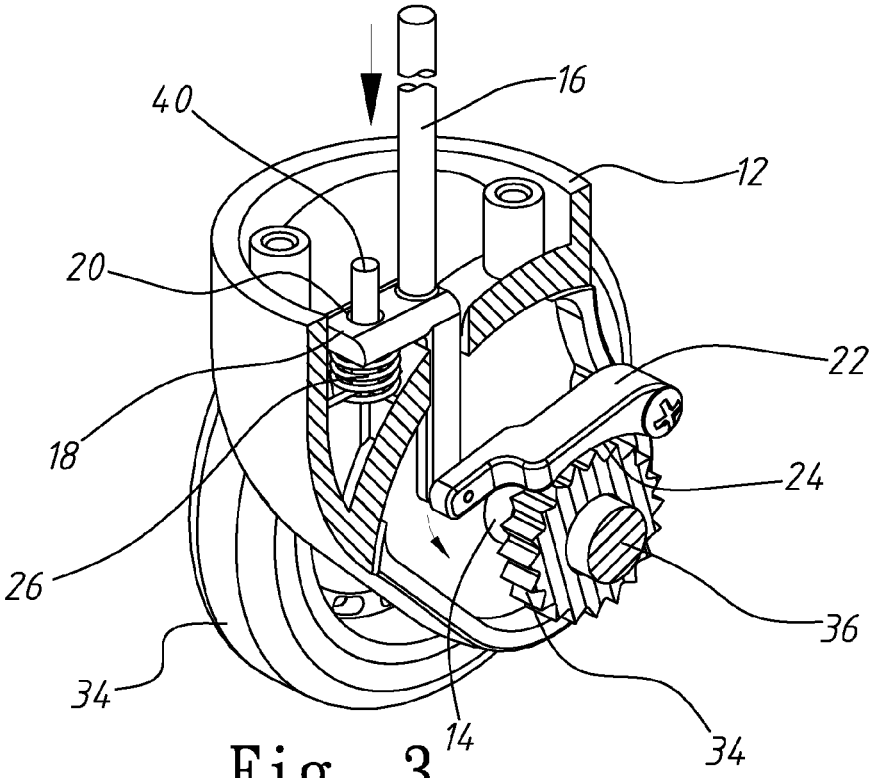
FIG. 3 is a perspective view schematically showing the operation of a swivelable trunk wheel assembly from a moving state to a braking state according to the present invention.
Figure 4:
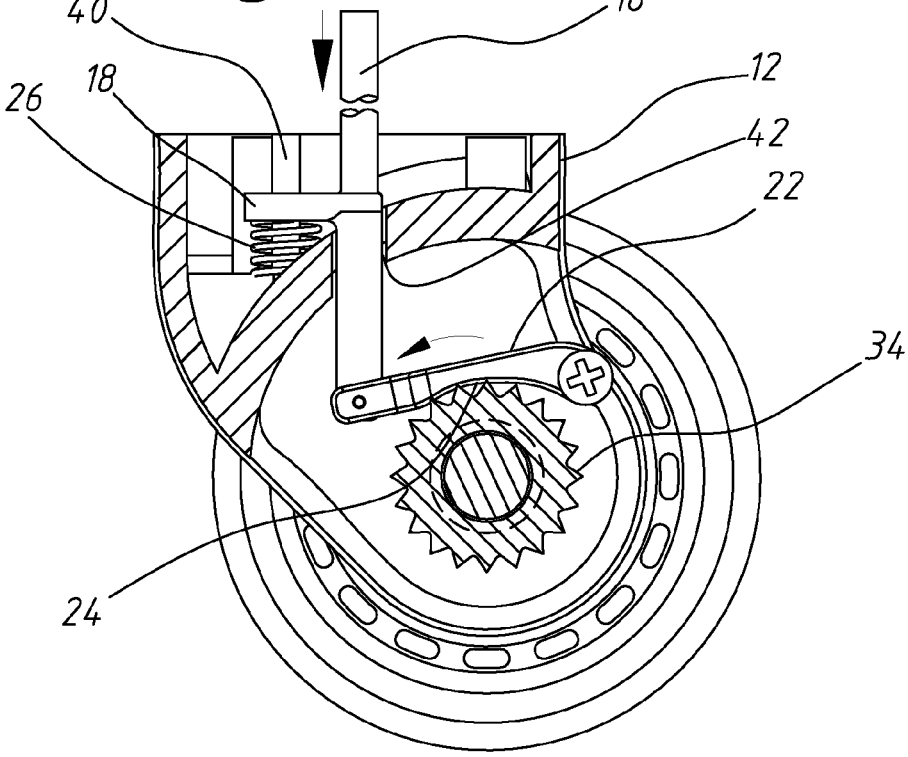
FIG. 4 is a sectional view schematically showing the operation of a swivelable trunk wheel assembly from a moving state to a braking state according to the present invention.

Refer to FIG. 3 and FIG. 4. When the moving trunk is to be braked, the user operates the control mechanism to drive the push rod 16 to descend, and the push rod 16 will push the press block 22 to rotate with respect to a pivotal point where the other end of the press block 22 is joined to the wheel frame 12 until the rubber face 24 contacts the friction portion 34. The rubber face 24 will rub the friction portion 34 to slow down or brake the wheels 32.

Figure 5:
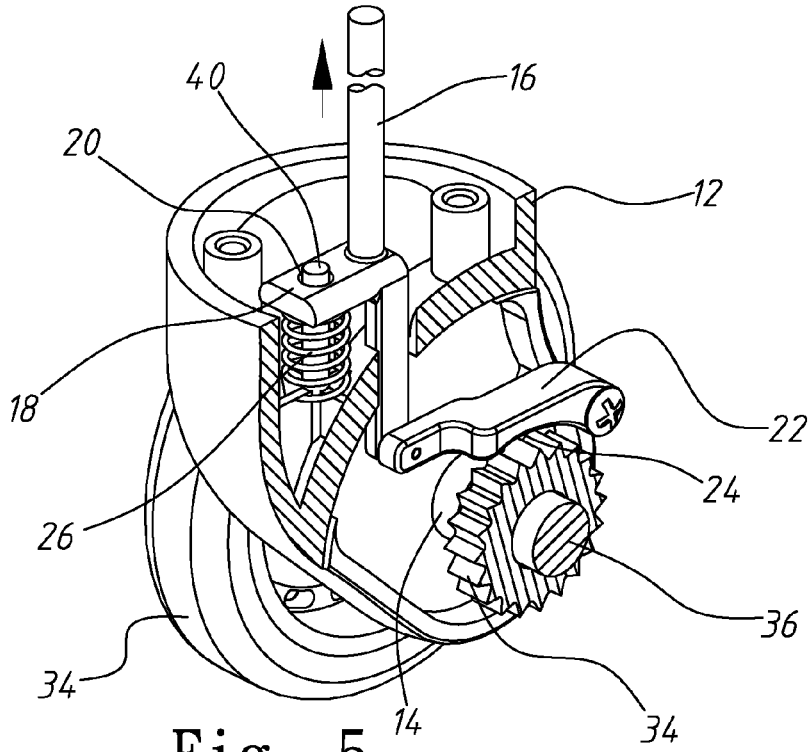
FIG. 5 is a perspective view schematically showing the operation of a swivelable trunk wheel assembly from a braking state to a moving state according to the present invention.
Figure 6:
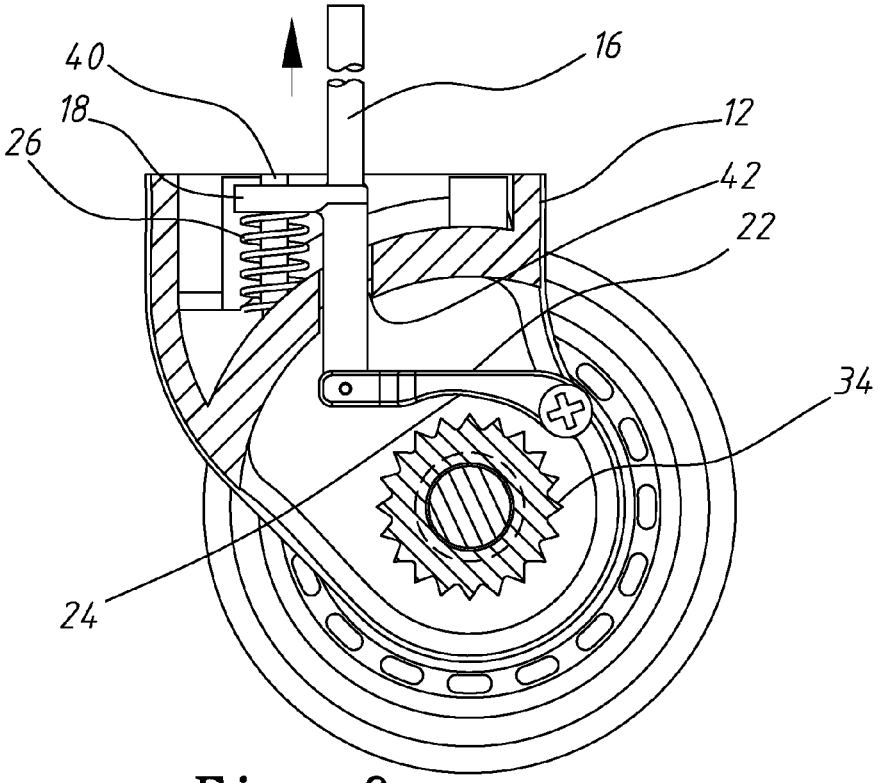
FIG. 6 is a sectional view schematically showing the operation of a swivelable trunk wheel assembly from a braking state to a moving state according to the present invention.

Refer to FIG. 5 and FIG. 6. When the user intends to resume moving the trunk, he operates the control mechanism to drive the push rod 16 to ascend, the push rod 16 will lift up the press block 22 to rotate with respect to a pivotal point where the other end of the press block 22 is joined to the wheel frame 12 to make the rubber face 24 detach from the friction portion 34. Then, the wheels 32 can move again.

The preferred embodiments described above are only to exemplify the present invention but not to limit the scope of the present invention. Therefore, the equivalent modification or variation according to the shapes, structures, characteristics and spirit of the present invention is to be also included within the scope of the present invention.

What is claimed is:

1. A swivelable trunk wheel assembly, comprising:

a wheel frame having two accommodation portions respectively at two sides thereof;

a guide hole arranged in said wheel frame;

a push rod with one side thereof placed inside said guide hole;

a press block with one end thereof coupled to said push rod and another end thereof pivotally coupled to said wheel frame;

a hollow pivotal shaft arranged in said wheel frame, wherein two ends of said hollow pivotal shaft respectively extend out from said accommodation portions;

a sleeve pipe placed inside said hollow pivotal shaft, wherein two ends of said sleeve pipe respectively protrude from two ends of said hollow pivotal shaft;

two wheels respectively joined to two ends of said sleeve pipe and accommodated in said accommodation portions, wherein said wheels has a friction portion at a side near said wheel frame, and said push rod drive said press block to rub said friction portion and brake said wheels; and two rivets respectively passing through said wheels and joined to said sleeve pipe.

2. The swivelable trunk wheel assembly according to claim 1, wherein another end of said push rod protrudes from said wheel frame and is coupled to a control mechanism; said control mechanism drive said push rod to brake said wheels with friction.

3. The swivelable trunk wheel assembly according to claim 2, wherein said control mechanism is arranged in a trunk handle.

4. The swivelable trunk wheel assembly according to claim 1, wherein a lateral plate horizontally extends out from between two ends of said push rod; said lateral plate has a through-hole; a vertical rod on said wheel frame is inserted into and sleeved by said through-hole.

5. The swivelable trunk wheel assembly according to claim 4, wherein a compression spring is arranged in said vertical rod.

6. The swivelable trunk wheel assembly according to claim 1, wherein said press block has a rubber face in a side near said friction portion.

7. The swivelable trunk wheel assembly according to claim 1, wherein said sleeve pipe is a metallic sleeve pipe.

8. The swivelable trunk wheel assembly according to claim 1, wherein said friction portion is a coarsened body.

9. The swivelable trunk wheel assembly according to claim 8, wherein said coarsened body is a gear.

10. The swivelable trunk wheel assembly according to claim 1, wherein said wheel frame, said hollow pivotal shaft and said sleeve pipe are fabricated into a one-piece part.

* * * * *